US006676222B2

(12) United States Patent
Hsu

(10) Patent No.: US 6,676,222 B2
(45) Date of Patent: Jan. 13, 2004

(54) METHOD OF MAKING BATH SCRUBBERS

(76) Inventor: Wei-Ling Hsu, 7F, No. 69-2, Alley 27, Lane 372, Sec. 5, Chung-Hsiao E. Rd., Taipei (TW)

( * ) Notice: Subject to any disclaimer, the term of this patent is extended or adjusted under 35 U.S.C. 154(b) by 376 days.

(21) Appl. No.: 09/863,336

(22) Filed: May 24, 2001

(65) Prior Publication Data

US 2002/0175558 A1 Nov. 28, 2002

(51) Int. Cl.[7] ..... A46D 3/00; A47K 7/02
(52) U.S. Cl. ..... 300/21; 15/209.1; 15/229.11
(58) Field of Search ..... 15/209.1, 229.11; 300/21

(56) References Cited

U.S. PATENT DOCUMENTS 5,784,747 A * 7/1998 Girardot et al. ..... 15/229.11
6,131,234 A * 10/2000 Chen ..... 15/229.11

* cited by examiner

*Primary Examiner*—Mark Spisich
(74) *Attorney, Agent, or Firm*—Birch, Stewart, Kolasch & Birch, LLP

(57) ABSTRACT

A method of making spherical bath scrubbers includes the steps: setting up a first pillar, a second pillar, a third pillar and a fourth pillar in an upright and juxtaposed manner; slipping a first netting tube around the third and the fourth pillar; slipping a second netting tube around the first and the second pillar to surround the first netting tube from outside, and using a rope to tie and fasten the first and the second netting tube together between the third and the fourth pillar; and removing the first and the second setting tube from the four pillars in a progressive way to form a completed bath scrubber.

5 Claims, 9 Drawing Sheets

METHOD OF MAKING BATH SCRUBBERS

BACKGROUND OF THE INVENTION

This invention relates to a method of making bath scrubbers and particularly a bath scrubber that has two layers of meshes to form a denser netting structure for adhering soap more effectively.

Conventionally, when people taking bath to clean the body, they usually rub the soap over the wetted body to generate soap foams and bubbles, then rinse the body with water to wash the soap foams away. However for people who have a lot of perspiration and dirt accumulated on the skin, using merely water and soap to clean the body is not enough. Some physical means such as abrasion have to be used to thoroughly remove the accumulated dirt and sweat from the skin. Netting bath scrubbers are to serve this function and have gained growing market acceptance in recent years.

However the netting bath scrubbers now available in the market place are mostly made of one layer of netting sheet. They cannot adsorb sufficient amount of soap foams. To fold and stack the netting sheet a number of times may increase soap adherence power. However the stacking netting sheet is easily falling apart when use and may become an annoyance to users.

The sponges usually have greater adhering power and may generate more soap foams when used to scrub human body, however the sponges are generally very soft and have a poorer scrubbing force. In order to equip the desired scrubbing power and greater soap adhering capability, spherical netting bath scrubbers have been developed and introduced.

Conventional methods of making netting bath scrubbers, such as those disclosed in prior arts generally use two upright bracing members to stretch a tubular network body for forming the scrubbers or ruffles. The resulting netting structure is not very sturdy. The twisting and squeezing exerted on the netting scrubber during bathing could easily loosen its structure and result in decreasing of soap adsorption capability. The tying string of the netting scrubber could even get loose and drop out.

Furthermore, the scrubbers made through two bracing members do not have spherical shapes and appearance. They are generally not sightly or attractive.

Another prior art discloses another method for making netting sponge. It includes four supports for stretching two netting tubes, then binds the stretched tubes together. Basically, it is not much different from the methods of using two bracing members set forth above, and the finished product still has same sort of problems. The mesh structure is not dense enough and soap adhering power is not desirable. Moreover, the netting scrubbers or sponges being made have only one color and cannot make change in color.

SUMMARY OF THE INVENTION

The primary object of this invention to resolve aforesaid disadvantages. This invention aims at providing a method for making bath scrubbers that have a dual layer structure so that the resulting mesh body will have a denser structure and greater soap adhering power.

Another object of this invention is to make the bath scrubbers having different colors to add their appealing.

In order to attain the foregoing objects, the method of this invention uses a first, a second, a third and a fourth upright pillars aligned in a juxtaposed manner. Then slip a first netting tube around the third and fourth pillars in the center, and slip a second netting tube around the first and second pillars surrounding the first netting tube. Tie and fasten the first and second netting tube with a rope between the third and fourth pillars. Finally remove the first and second netting tube from the four pillars in a progressive way to form the bath scrubber.

BRIEF DESCRIPTION OF THE DRAWINGS

The invention, as well as its many advantages, may be further understood by the following detailed description and drawings, in which.

DESCRIPTION OF THE PREFERRED EMBODIMENTS

Figure 1:
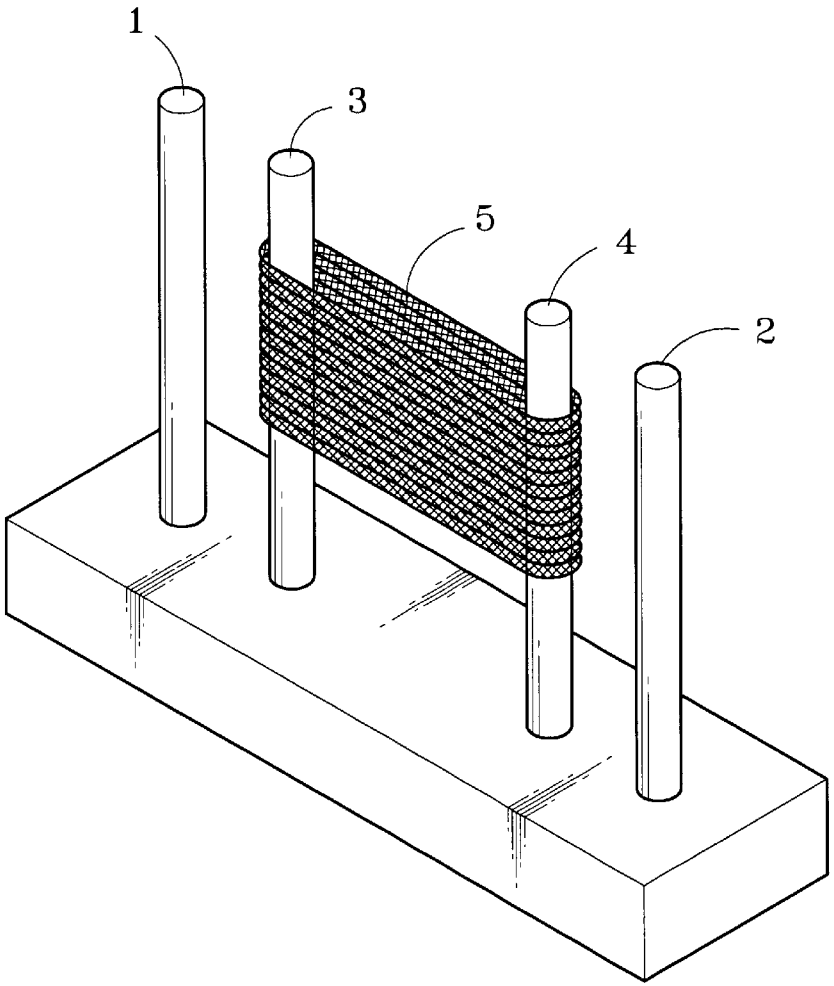
FIG. 1 is a schematic view of the first step of this invention.

Referring to FIG. 1, the first step of the method according to this invention is to set up a first pillar 1, a second pillar 2, a third pillar 3 and a fourth pillar 4 in an upright and juxtaposed manner, then slip a first netting tube 5 through an opening at one end thereof around the third and fourth pillar 3 and 4.

Figure 2:
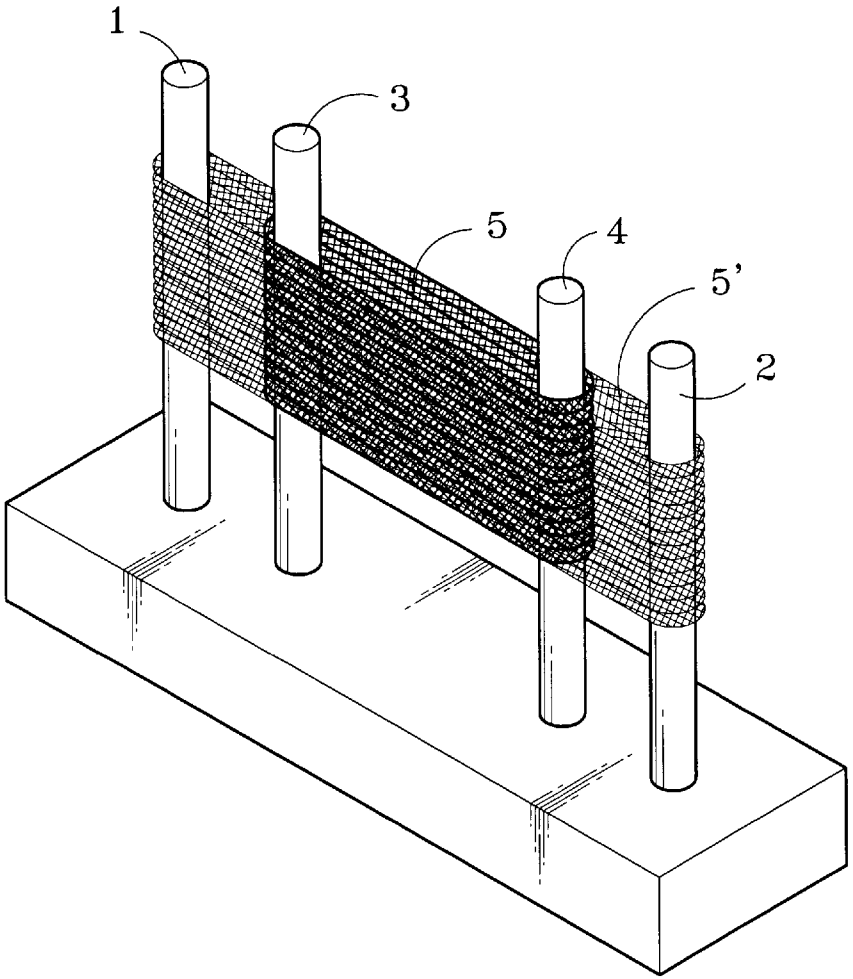
FIG. 2 is a schematic view of the second step of this invention.

Referring to FIG. 2, the second step is to slip a second netting tube 5' around the first and second pillar 1 and 2 such that the second netting tube 5' will surround the first netting tube 5 from outside.

Figure 3:
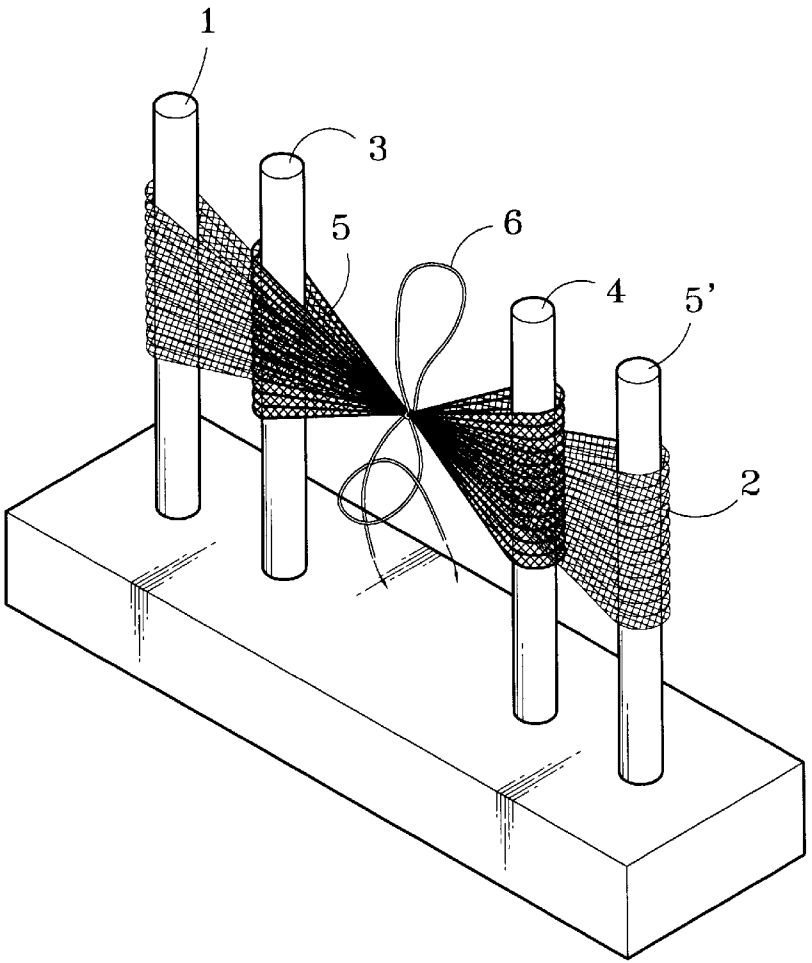
FIG. 3 is a schematic view of the third step of this invention.

Referring to FIG. 3, the third step is to tie and fasten the first and second netting tube 5 and 5' together at the center which is located between the third and fourth pillars 3 and 4 with a rope 6.

Figure 4:
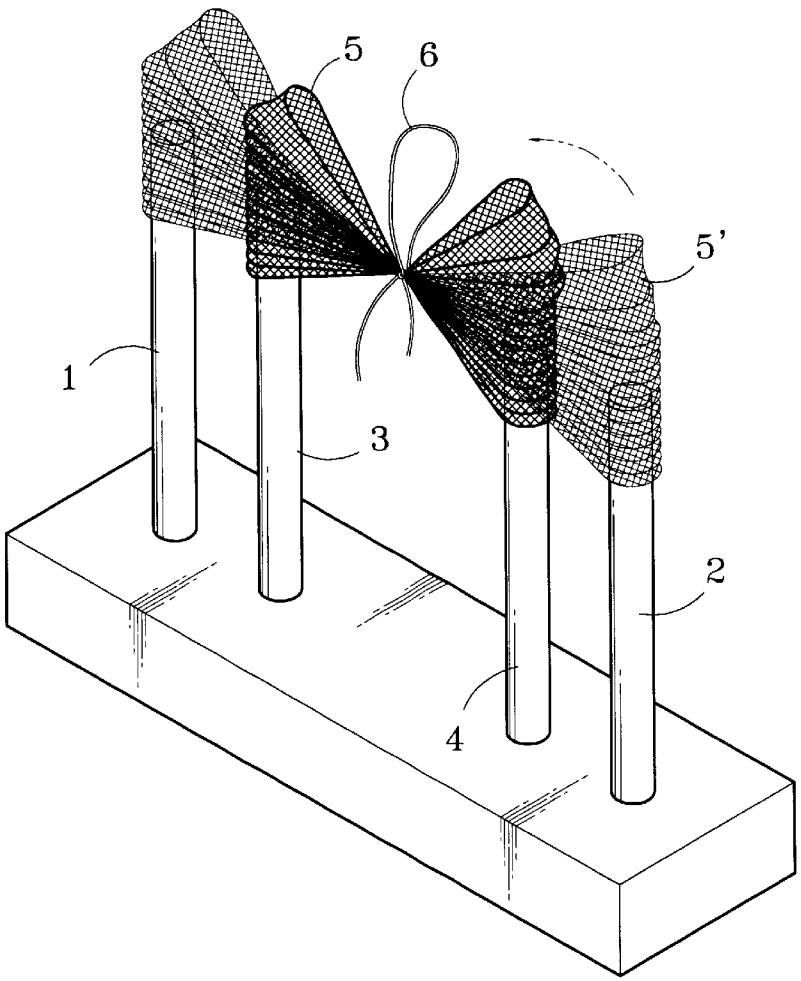
FIG. 4 is a schematic view of the fourth step of this invention.
Figure 5:
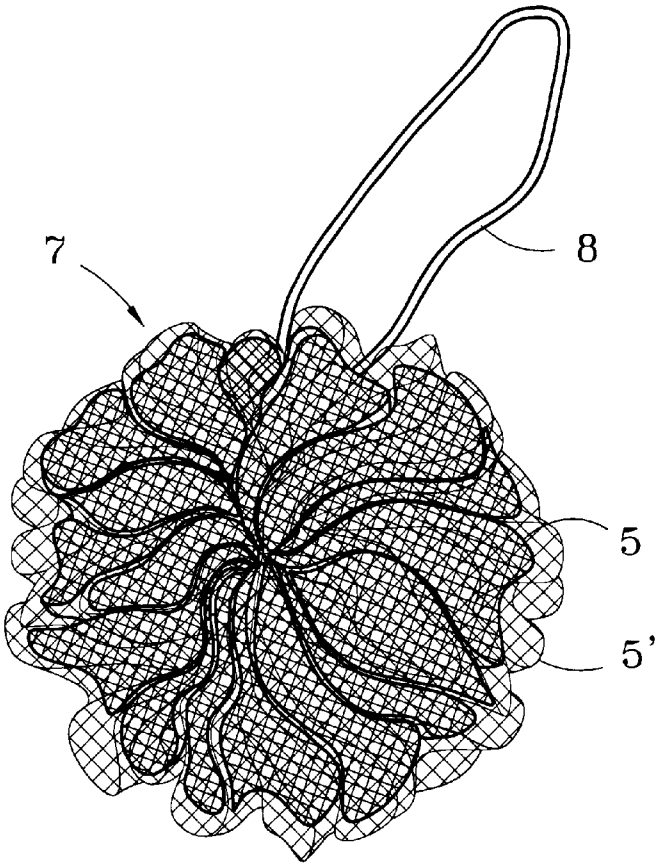
FIG. 5 is a pictorial view of a finished bath scrubber made by this invention.

Referring to FIG. 4, the fourth step is to remove the first and second netting tube 5 and 5' from the four pillars 1, 2, 3 and 4 in a progressive way to form a completed bath scrubber 7 (as shown in FIG. 5). The first and second netting tube 5 and 5' may have different colors so that the completed bath scrubber 7 will also have different colors. The rope 6 may be tied one more time to form a handle loop 8 to facilitate users holding.

Figure 6:
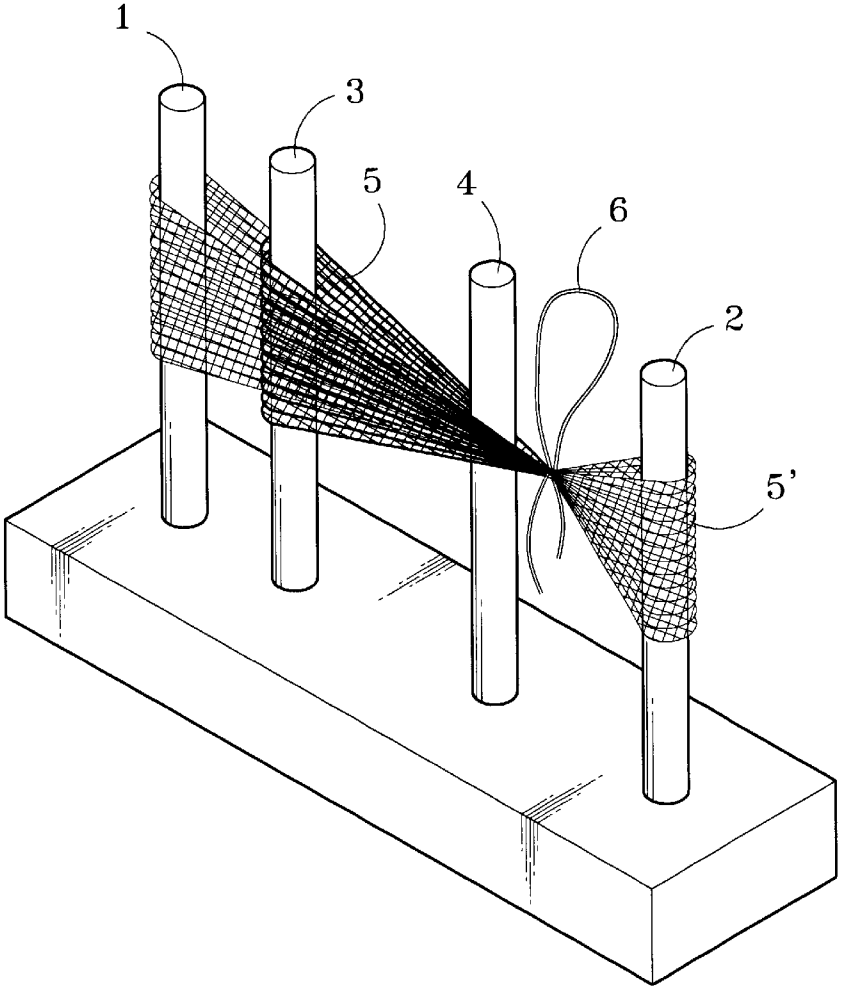
FIG. 6 is a schematic view of another embodiment of this invention.
Figure 7:
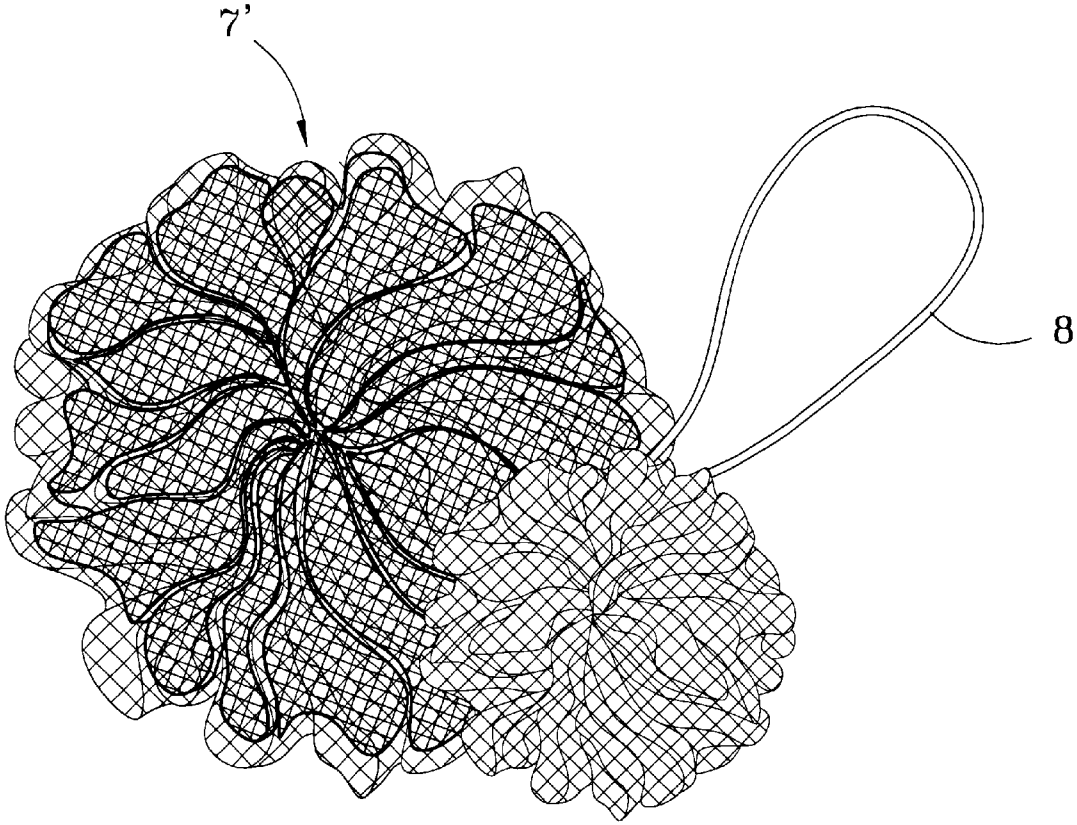
FIG. 7 is a pictorial view of a finished bath scrubber made according to FIG. 6.

Referring to FIGS. 6 and 7 show another embodiment of this invention. Comparing with the embodiment set forth above, at the third step, the netting tubes 5 and 5' are being tied and fastened between the fourth and second pillar 4 and 2 (or between the first and third pillar 1 and 3). As a result, when the netting tubes 5 and 5' are removed from the four pillars 1, 2, 3 and 4, another type of bath scrubber 7' will be formed. The rope 6 may also be tied another time to form a handle loop 8 to facilitate users holding.

Figure 8:
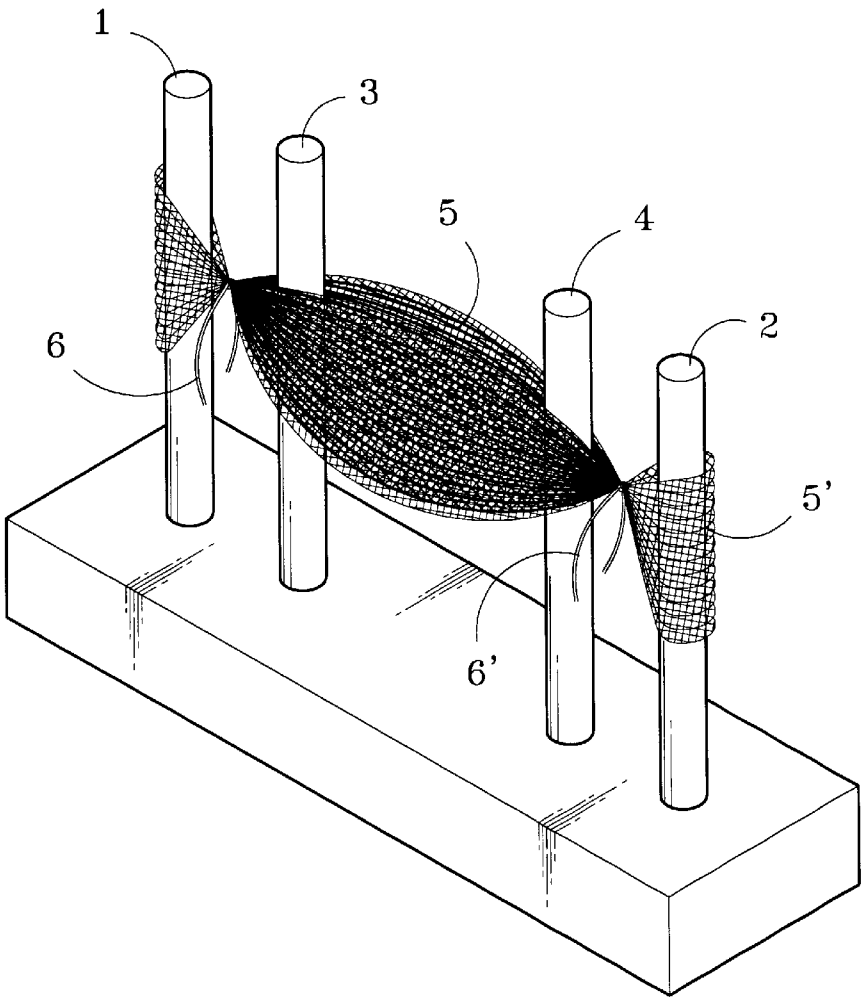
FIG. 8 a schematic view of yet another embodiment of this invention
Figure 9:
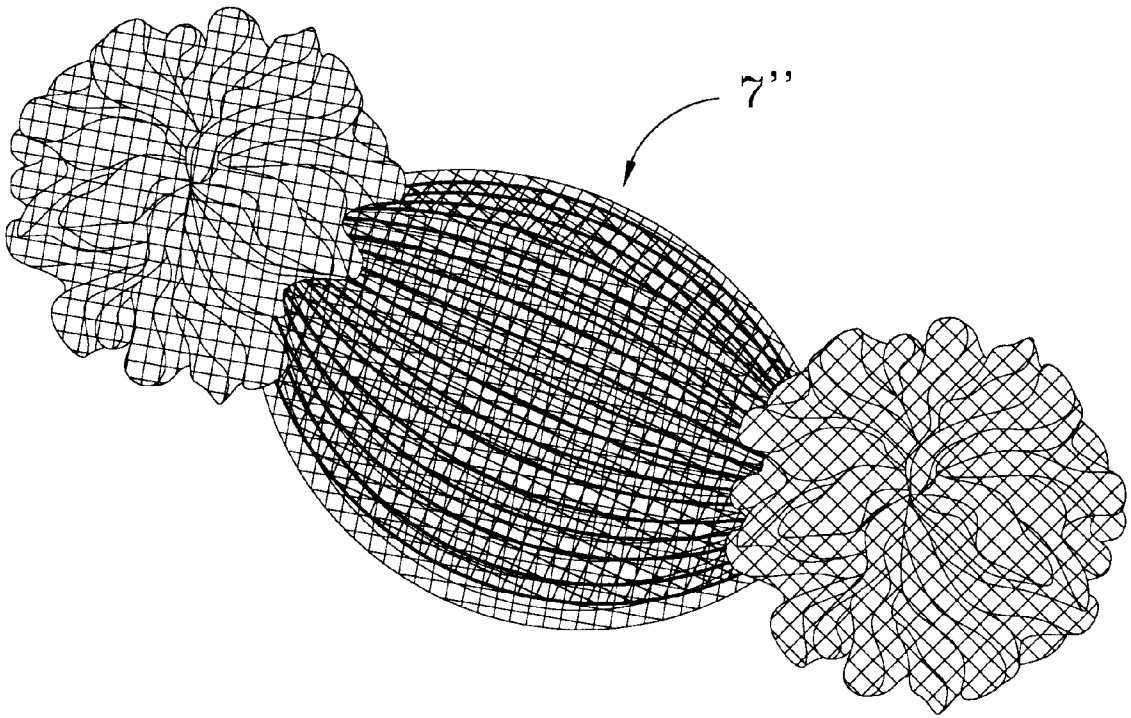
FIG. 9 is a pictorial view of a finished bath scrubber made according to FIG. 8.

Referring to FIGS. 8 and 9 for yet another embodiment of this invention which is largely constructed like the second embodiment set forth above, however, instead of using one piece of rope, two pieces of rope 6 and 6' are being used to tie and fasten respectively the netting tubes 5 and 5' between the first and third pillar 1 and 3, and the fourth and second pillars 4 and 2. Hence when the tied netting tubes 5 and 5' are removed from the four pillars 1, 2, 3 and 4, another type of bath scrubber 7" will be formed.

By means of the foregoing methods, the bath scrubbers may be made more densely and constructed more sturdily, and may adhere more soap foams when in use and are more effective for cleaning body, and also are more durable.

While the preferred embodiments of this invention have been set forth for purpose of disclosure, modifications of the disclosed embodiments of this invention as well as other embodiments thereof may occur to those skilled in the art. Accordingly, the appended claims are intended to cover all embodiments which do not depart from the spirit and scope of this invention.

What is claimed is:

1. A method of making bath scrubbers, comprising:

a. setting up a first pillar, a second pillar, a third pillar and a fourth pillar in an upright and juxtaposed manner, and slipping a first netting tube through an opening at one end thereof around the third and the fourth pillar;

b. slipping a second netting tube around the first and the second pillar to surround the first netting tube from outside;

c. using a rope to tie and fasten the first and the second netting tube together in the axial direction thereof at the center of the netting tubes between the third and the fourth pillar; and d. removing the first and the second netting tube from the four pillars in a progressive way to form a completed bath scrubber which has a denser mesh structure for adhering more soap.

2. The method according to claim 1, wherein the first netting tube and the second netting tube have different colors for forming the bath scrubber with mixed colors.

3. The method according to claim 1, wherein the rope is tied another time for forming a handle loop to facilitate users holding.

4. A method of making bath scrubbers, comprising:

a. setting up a first pillar, a second pillar, a third pillar and a fourth pillar in an upright and juxtaposed manner, and slipping a first netting tube through an opening at one end thereof around the third and the fourth pillar;

b. slipping a second netting tube around the first and the second pillar to surround the first netting tube from outside;

c. using a rope to tie and fasten the first and the second netting tube together in the axial direction thereof between the fourth and the second pillar or between the first and the third pillar; and d. removing the first and the second netting tube from the four pillars in a progressive way to form a completed bath scrubber which has a denser mesh structure or adhering more soap.

5. A method of making bath scrubbers, comprising:

a. setting up a first pillar, a second pillar, a third pillar and a fourth pillar in an upright and juxtaposed manner, and slipping a first netting tube through an opening at one end thereof around the third and the fourth pillar;

b. slipping a second netting tube around the first and the second pillar to surround the first netting tube from outside;

c. using two pieces of rope to tie and fasten the first and the second netting tube together in the axial direction respectively between the fourth and the second pillar and between the first and the third pillar; and d. removing the first and the second netting tube from the four pillars in a progressive way to form a completed bath scrubber which has a denser mesh structure for adhering more soap.

* * * * *